US009132523B2

(12) United States Patent
Lee et al.

(10) Patent No.: US 9,132,523 B2
(45) Date of Patent: Sep. 15, 2015

(54) CHEMICAL MECHANICAL POLISH PROCESS CONTROL FOR IMPROVEMENT IN WITHIN-WAFER THICKNESS UNIFORMITY

(75) Inventors: Shen-Nan Lee, Jhudong (TW); Ying-Mei Lin, Keelung (TW); Yu-Jen Cheng, Hsin-Chu (TW); Keung Hui, Hsin-Chu (TW); Huan-Just Lin, Hsin-Chu (TW)

(73) Assignee: Taiwan Semiconductor Manufacturing Company, Ltd., Hsin-Chu (TW)

( * ) Notice: Subject to any disclaimer, the term of this patent is extended or adjusted under 35 U.S.C. 154(b) by 230 days.

(21) Appl. No.: 13/412,260

(22) Filed: Mar. 5, 2012

(65) Prior Publication Data

US 2012/0164918 A1 Jun. 28, 2012

Related U.S. Application Data

(62) Division of application No. 12/250,239, filed on Oct. 13, 2008, now Pat. No. 8,129,279.

(51) Int. Cl.

| | |
|---|---|
| ***H01L 21/302*** | (2006.01) |
| ***B24B 49/12*** | (2006.01) |
| ***B24B 37/013*** | (2012.01) |

(52) U.S. Cl.

CPC ..... *B24B 37/013* (2013.01); *B24B 49/12* (2013.01)

(58) Field of Classification Search

USPC ..... 156/345.12, 345.13, 345.15, 345.19

See application file for complete search history.

(56) References Cited

U.S. PATENT DOCUMENTS

| | | | | |
|---|---|---|---|---|
| 6,544,103 | B1 * | 4/2003 | Korovin | 451/8 |
| 6,623,333 | B1 * | 9/2003 | Patel et al. | 451/9 |
| 6,630,360 | B2 | 10/2003 | Christian et al. | |
| 6,632,124 | B2 * | 10/2003 | Adams et al. | 451/5 |
| 6,728,587 | B2 | 4/2004 | Goldman et al. | |
| 6,741,903 | B1 | 5/2004 | Bode et al. | |
| 6,921,466 | B2 * | 7/2005 | Hongo et al. | 204/198 |
| 7,226,339 | B2 | 6/2007 | Benvegnu et al. | |
| 2003/0013387 | A1 | 1/2003 | Tsai et al. | |
| 2008/0242081 | A1 | 10/2008 | Idani | |
| 2008/0242196 | A1 * | 10/2008 | Marxsen et al. | 451/8 |
| 2009/0036026 | A1 | 2/2009 | David et al. | |
| 2012/0164918 | A1 * | 6/2012 | Lee et al. | 451/6 |

* cited by examiner

*Primary Examiner* — Sylvia R MacArthur

(74) *Attorney, Agent, or Firm* — Slater & Matsil, L.L.P.

(57) ABSTRACT

A method of performing chemical mechanical polish (CMP) processes on a wafer includes providing the wafer; determining a thickness profile of a feature on a surface of the wafer; and, after the step of determining the thickness profile, performing a high-rate CMP process on the feature using a polish recipe to substantially achieve a within-wafer thickness uniformity of the feature. The polish recipe is determined based on the thickness profile.

20 Claims, 5 Drawing Sheets

CHEMICAL MECHANICAL POLISH PROCESS CONTROL FOR IMPROVEMENT IN WITHIN-WAFER THICKNESS UNIFORMITY

This application is a divisional of U.S. patent application Ser. No. 12/250,239, filed on Oct. 13, 2008 now U.S. Pat. No. 8,129,279, and entitled "Chemical Mechanical Polish Process Control for Improvement in Within-Wafer Thickness Uniformity," which application is incorporated herein by reference.

TECHNICAL FIELD

This invention relates generally to integrated circuit manufacturing processes, and more particularly to chemical mechanical polish (CMP) processes, and even more particularly to controlling both within-wafer thicknesses and wafer-to-wafer thicknesses resulting from the CMP processes.

BACKGROUND

Chemical mechanical polish (CMP) processes are widely used in the fabrication of integrated circuits. As an integrated circuit is built up layer by layer on the surface of a semiconductor wafer, CMP processes are used to planarize the topmost layer or layers to provide a leveled surface for subsequent fabrication steps. CMP processes are carried out by placing the wafer in a carrier that presses the wafer surface to be polished against a polish pad attached to a platen. Both the platen and the wafer carrier are rotated while slurry containing both abrasive particles and reactive chemicals is applied to the polish pad. The slurry is transported to the wafer surface via the rotation of the porous polish pad. The relative movement of the polish pad and wafer surface coupled with the reactive chemicals in the slurry allows the CMP process to level the wafer surface by means of both physical and chemical forces.

CMP processes can be used for the fabrication of an integrated circuit. For example, CMP processes may be used to planarize the inter-level dielectric layer and the inter-metal dielectrics that separate the various circuit layers in an integrated circuit. CMP processed are also commonly used in the formation of the copper lines that interconnect components of integrated circuits.

To improve the yield of the CMP process, both within-wafer (WiW) uniformity and wafer-to-wafer (WtW) uniformity need to be controlled. WiW uniformity is the uniformity of thicknesses throughout a wafer, while WtW uniformity is the uniformity of thicknesses of different wafers. Conventionally, particularly in pre 32 nm technologies, the control in WtW uniformity is achieved by lot-based advanced process control (APC), which uses the mean value of multiple points (for example, nine points) on each of the wafers to control the CMP process. It was thus expected that if WtW uniformity is achieved, the WiW uniformity will also meet the target. However, for the formation of small-scale integrated circuits, particularly integrated circuit formation of 32 nm and beyond, this is no longer true. Even if the lot-based APC results in substantially uniform mean values of thicknesses from wafer to wafer, or from lot to lot (with each lot including, for example, 25 wafers), there may be significant variation in thicknesses inside each of the wafers. Therefore, the WiW uniformity may not meet design requirements. New CMP methods and new APC models are thus need to achieve both the WiW uniformity and the WtW uniformity.

SUMMARY OF THE INVENTION

In accordance with one aspect of the present invention, a method of performing chemical mechanical polish (CMP) processes on a wafer includes providing the wafer; determining a thickness profile of a feature on a surface of the wafer surface; and, after the step of determining the thickness profile, performing a high-rate CMP process using a polishing recipe to substantially achieve a within wafer thickness uniformity of the feature. The polishing recipe is determined based on the thickness profile.

In accordance with another aspect of the present invention, a method of performing CMP processes on a wafer includes providing the wafer; determining a thickness profile of a feature on a top surface of the wafer; performing a first CMP process on the feature using a polish recipe to achieve a substantial within-wafer thickness uniformity of the feature, wherein the polish recipe is determined based on the thickness profile; and performing a close-loop control including a second CMP process on the feature to adjust a thickness of the feature to a final target thickness.

In accordance with yet another aspect of the present invention, a method of performing CMP processes on an inter-layer dielectric (ILD) of a wafer includes providing the wafer; performing a first measurement to determine a thickness profile of the ILD; determining a polish recipe based on the thickness profile; performing a first CMP process on the ILD using the polish recipe, wherein, after the first CMP process, the ILD has a substantial within-wafer thickness uniformity; determining a target thickness of the ILD for a low-rate CMP process; performing the low-rate CMP process on the ILD and simultaneously monitoring a thickness of the ILD; stopping the low-rate CMP process when the thickness of the ILD reaches the target thickness; performing a buffing CMP process for a pre-determined polish time; after the step of performing the buffing CMP process, performing a second measurement to determine ILD thickness; comparing the thickness of the ILD obtained from the second measurement with a final target thickness of the ILD to determine a thickness difference; and feeding back the thickness difference to adjust the pre-determined polish time.

The advantageous features of the present invention include improved within-wafer uniformity and improved wafer-to-wafer uniformity after the CMP processes, and dynamic process control to be adapted to time-dependent process conditions.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

A novel chemical mechanical polish (CMP) method and an advanced process control (APC) model for CMP processes are provided by the embodiments of the present invention. The intermediate stages of performing embodiments of the present invention are discussed. The variations of the embodiments are then discussed. Throughout the various views and illustrative embodiments of the present invention, like reference numbers are used to designate like elements. In the following discussion, the CMP process for polishing inter-layer dielectrics (ILD) are discussed, wherein the ILDs are used to cover integrated circuit devices, such as transistors, and for forming contact plugs therein. However, the teaching provided in subsequent paragraphs is readily available for the CMP process of other features and materials in the integrated circuits. Throughout the description, the term "final target thickness" is used to refer to the desirable thickness of the feature after CMP processes are performed.

Figure 1:
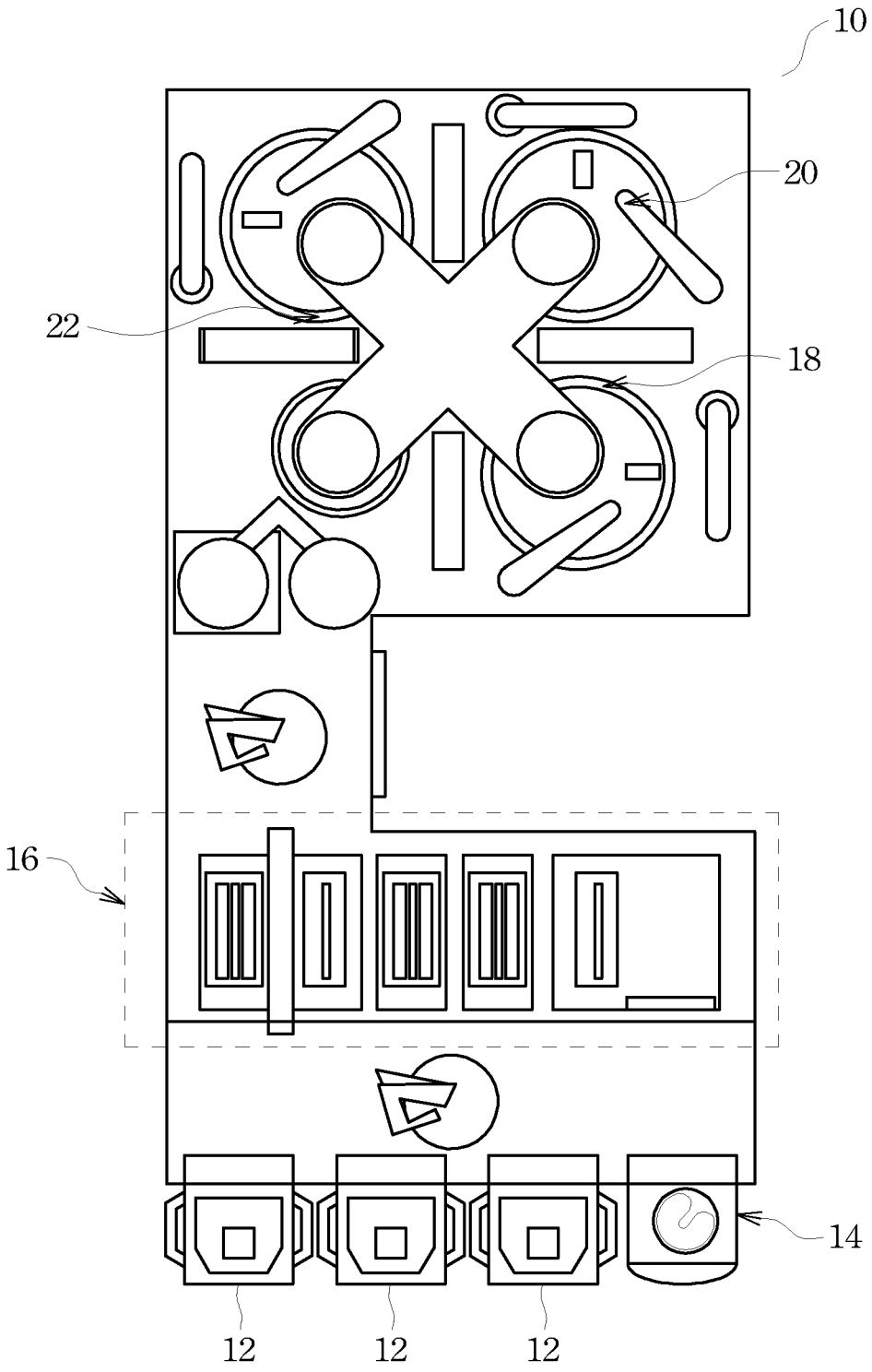
FIG. 1 illustrates a chemical mechanical polish (CMP) platform for performing the embodiments of the present invention.

FIG. 1 illustrates an exemplary CMP platform 10 for performing the embodiments of the present invention. CMP platform 10 includes loadlocks 12, dry metrology 14, cleaner 16, high-rate platen 18, low-rate platen 20, and buffing platen 22. Loadlocks 12 are used for loading wafers into CMP platform 10, and unloading the wafers. Dry metrology 14 is used to measure the thickness of features to be polished, such as an ILD. Cleaner 16 is used to clean the wafers after the CMP processes. High-rate platen 18 is used for polishing the wafer with a relatively high polishing rate. Low-rate platen 20 is used for polishing the wafer with a relatively low polishing rate, and used to detect whether the target thicknesses have been reached or not. Buffing platen 22 is used to lightly polish the wafers in order to fix defects and scratches, and to further polish the wafers to achieve the final target thickness.

Figure 2:
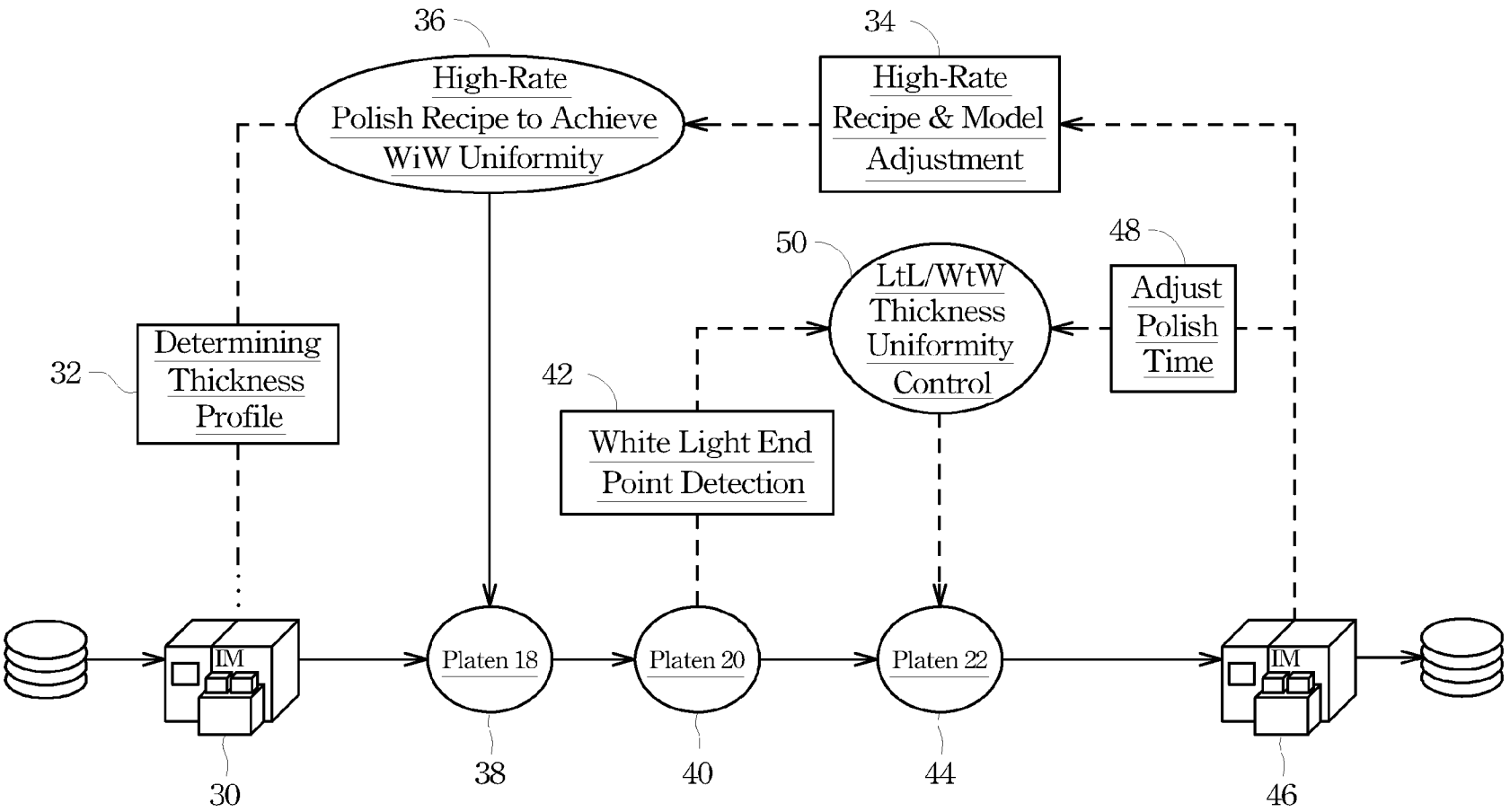
FIG. 2 illustrates a block diagram of an embodiment of the present invention.
Figure 3:
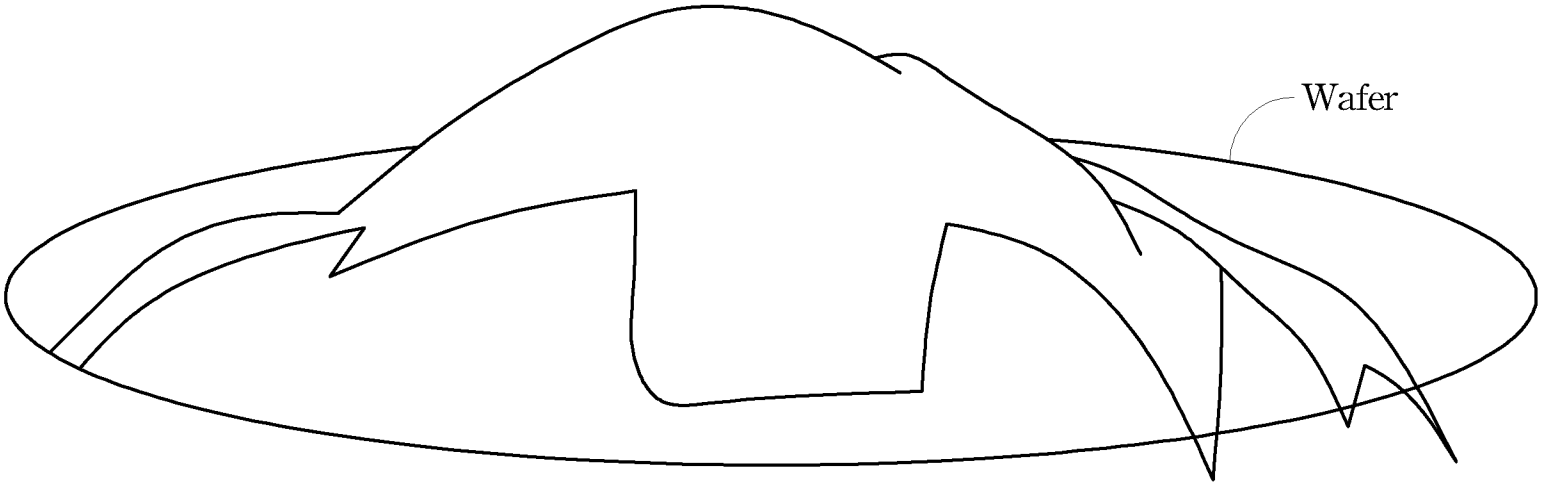
FIG. 3 illustrates an exemplary thickness profile of an inter-layer dielectric layer on a wafer.

The embodiments of the present invention may be explained using the process flow as shown in FIG. 2, with reference to the polish platform as shown in FIG. 1. The advanced process control (APC) model of the present invention is also explained with reference to FIGS. 1 and 2. The reference numerals referred to in the following discussion may either be in FIG. 1 or FIG. 2, and may not be specified explicitly. Referring to FIG. 2, first, in step 30, a wafer is loaded into CMP platform 10 through loadlock 12 (FIG. 1). Next, in step 32, the wafer is measured by dry metrology 14 (refer to FIG. 1). The thickness profile of the ILD throughout the wafer is thus obtained. FIG. 3 schematically illustrates an exemplary three-dimensional profile of the ILD on the wafer, wherein the peaks are where the ILD is thicker, and the valleys are where the ILD is thinner. It is appreciated that the thickness profile of different wafers may have different variations, for example, symmetric profiles or asymmetric profiles. The thickness profile may be obtained by measuring the thickness of the ILD at multiple points on the wafer.

Figure 4:
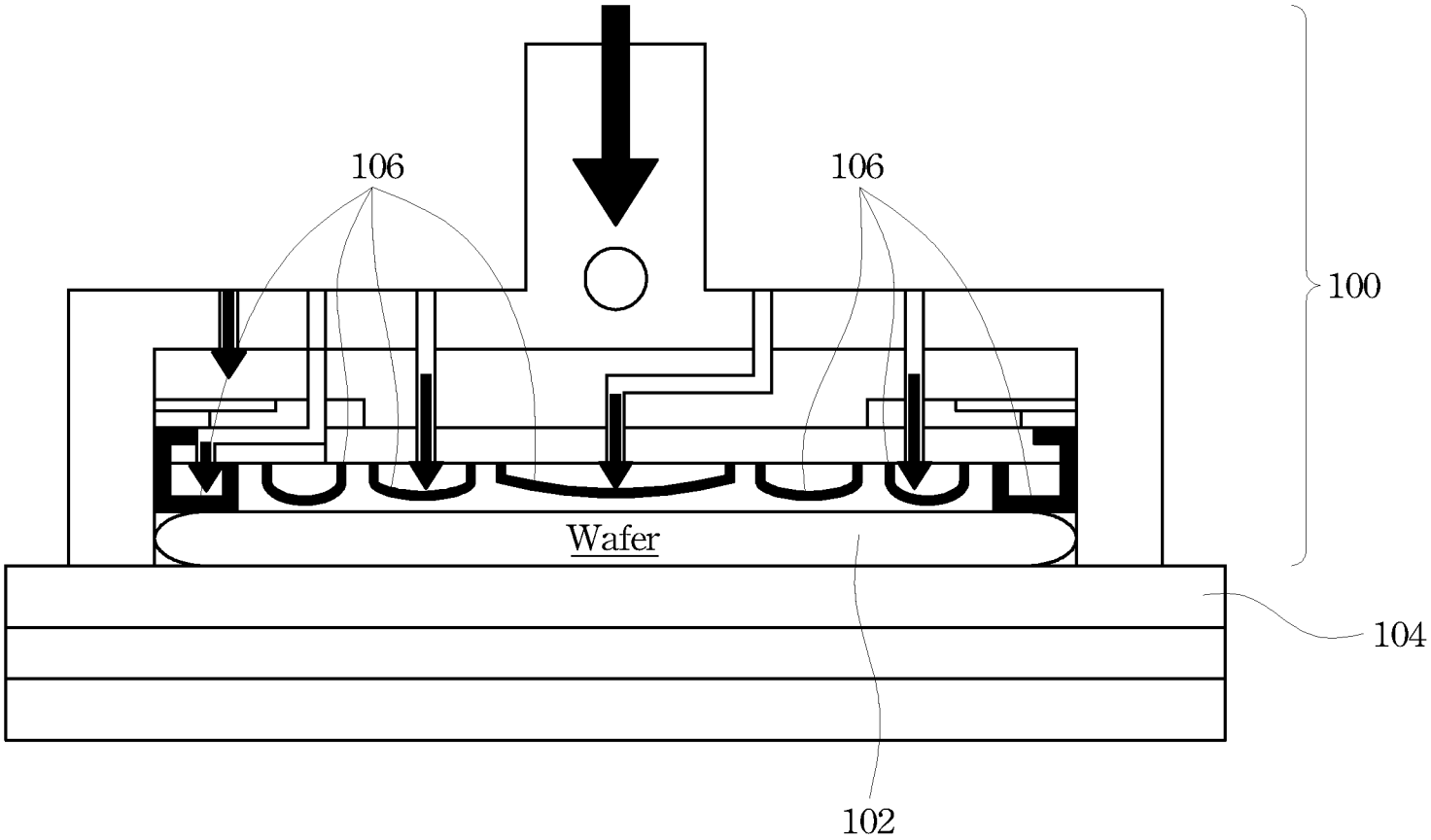
FIG. 4 illustrates a cross-sectional view of a zoned polish head.

In step 38, the wafer is then transferred to high-rate platen 18 (refer to FIG. 1) to perform a high-rate polish. In an embodiment, as is shown in FIG. 4, the polish head 100 is for holding and pushing wafer 102 against the respective polish pad 104, for example, with a plurality of concentric zones in the form of rings. The zones are achieved, for example, using different membranes 106, which has ring shapes if viewed from the bottom of the wafer. Each of membranes 106 may apply a same pressure to the wafer (denoted as wafer 102), and different membranes 106 may apply different pressures. By controlling the pressures applied to the different zones of wafer 102 (wherein different zones of the wafer correspond to different membranes), different zones of wafer 102 may have different polish rates, with greater pressures resulting in higher polish rates, and lower pressures resulting in lower polish rates.

Referring back to FIG. 2, depending on the thickness profile of the ILD, a polish recipe (block 36) for high-rate platen 18 is determined (block 34 in FIG. 2), wherein the polish recipe may be determined by a built-in controller (not shown) in a CMP automation platform (also referred to as an APC system, or a CMP platform) 10 (refer to FIG. 1). The polish recipe includes desirable pressures applied to different zones of the wafer and the desirable polish time of the high-rate CMP process. The ILD is then polished by high-rate platen 18 using the polish recipe (block 38 in FIG. 2). The polish recipe is designed such that after the high-rate polish, not only does the remaining thickness of the ILD roughly achieve the desirable value, but the top surface of the ILD is also substantially flat. Therefore, the within-wafer (WiW) thickness uniformity is achieved, with thicknesses of the remaining ILD at different locations of the wafer being substantially equal to each other. The remaining thickness of the ILD after the high-rate polish is preferably greater than the final target thickness.

Referring again to FIG. 2, after the high-rate polish, the wafer is transferred to low-rate platen 20 (step 40, please also refer to FIG. 1) to perform a low-rate polish with a white-light endpoint system. This white-light endpoint system is optional, and can be polished by time mode or other endpoint metrology. Since the high-rate polish has resulted in the ILD having the WiW uniformity, low-rate platen 20 does not need to compensate for the incoming wafer profile. The polish performed by low-rate platen 20 has a polish rate lower than that of high-rate platen 18. In an embodiment, the low-rate platen 20 has the endpoint detection ability for real time determining of the thickness of the ILD in real time. Therefore, before the low-rate polish starts, the target thickness of the ILD to be achieved by the low-rate polish needs to be pre-determined. It is realized that in subsequent steps (for example, the buffing polish performed by buffing platen 22 and the chemical cleaning performed by cleaner 16), additional top portions of the ILD will be removed. To achieve the final target thickness, the target thickness of the ILD for the low-rate polish may be the final target thickness plus the estimated thicknesses reduced by buffing platen 22 and cleaner 16.

Figure 5:
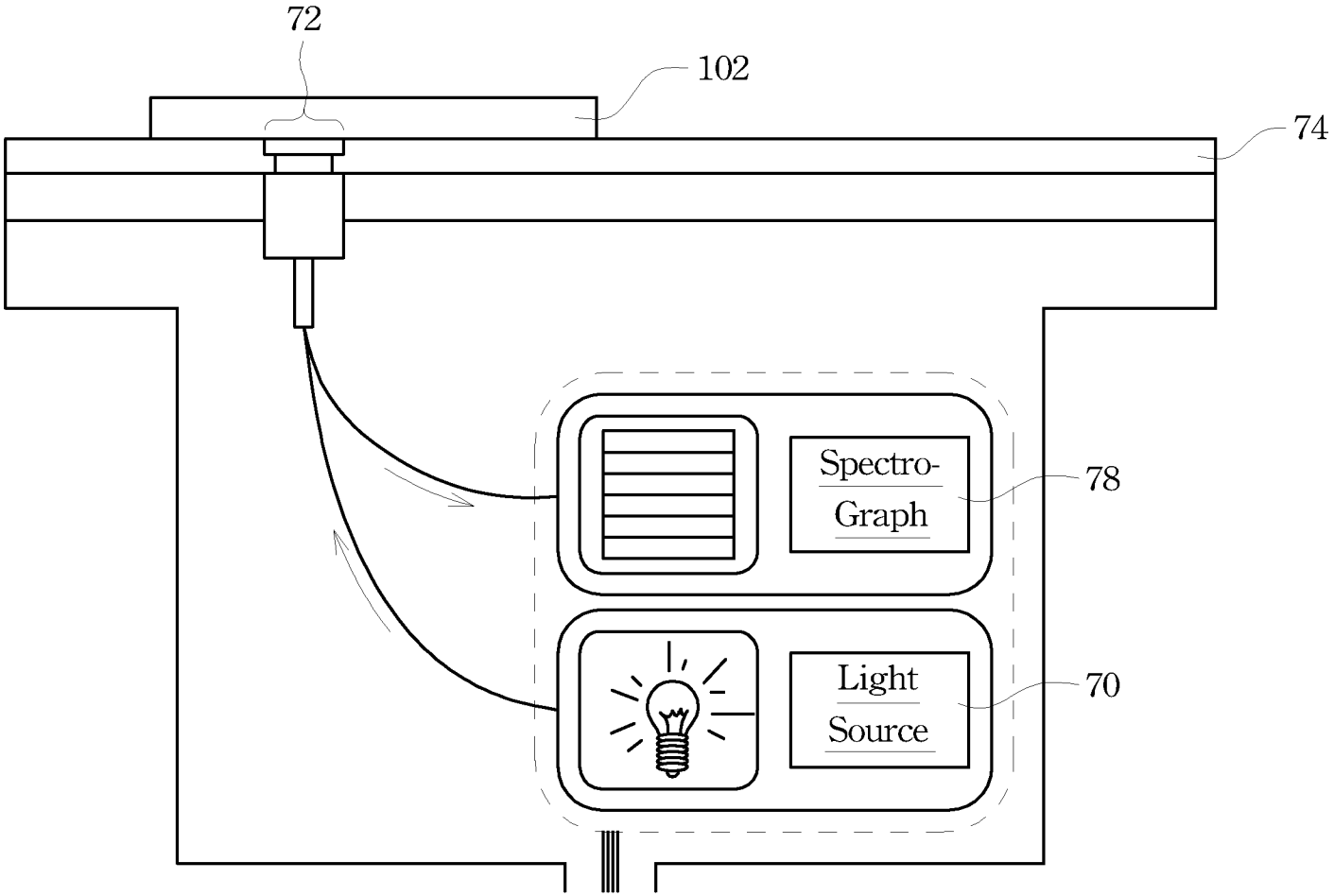
FIG. 5 illustrates an apparatus for performing white light end point detection.

In an embodiment, the thickness of the ILD may be monitored while the low-rate polish proceeds. FIG. 5 illustrates an exemplary device for monitoring the thickness of the ILD in real-time. The device includes light source 70, which can project light (white light with a wide band of frequencies) through window 72 in polish pad 74. When wafer 102 passes over window 72 during the low-rate polish, light is reflected by wafer 102 and received by a sensor (not shown), which is also placed in window 72 and facing wafer 102. The sensed signal is processed by spectrograph 78. Since the spectrum of the reflected light is affected by the thickness of the ILD, and each thickness value corresponds to one specific spectrum, spectrograph 78 may compare the spectrum of the reflected light with the pre-stored spectrums. When the spectrum of the reflected light matches the pre-stored spectrum of the target thickness, it is known that the target thickness of the ILD has been reached, and the low-rate polish stops (block 42 in FIG. 2)

After the low-rate polish, the wafer is transferred to the buffing platen 22 (refer to FIG. 1), and a buffing polish is performed (block 44 in FIG. 2). The buff polish has two functions. First, it is performed using a soft polish pad, and hence can eliminate the defects and scratches caused by the high-rate and low-rate polishes. Second, it removes a layer of ILD, so that the resulting thickness of the ILD is closer to the final target thickness. The buffing polish is performed for a pre-determined polish time, which polish time is specified by the buffing APC model, and will be discussed in detail in subsequent paragraphs. Next, the wafer is transferred to cleaner 16 (FIG. 1) to perform a chemical cleaning. As a result, an additional layer of the ILD is removed due to the use of cleaning chemicals. Since the removal amount of the chemical cleaning is known and has been taken into account in the determination of the buffing polish, the ILD thickness after the chemical cleaning is expected to be (although is not necessarily) the final target thickness; however, deviation may occur from time to time.

Next, as shown in step 46 of FIG. 2, the wafer is again transferred to dry metrology 14 (FIG. 1) to measure the ILD thickness. If the measured thickness is greater than or less than the final target thickness by a thickness difference beyond an acceptable margin, the APC model needs to be modified. The modification may include one or both of two approaches, as indicated by blocks 34 and 48. First, as shown in block 34, the thickness difference is fed back to the APC model to adjust the polish recipe used for the high-rate polish (step 34 in FIG. 2). The polish time and/or the zone pressure of the high-rate polish may be adjusted to compensate for the thickness difference, so that for the subsequently polished wafers, the thickness measured in step 46 may match the final target thickness. Second, the thickness difference is fed back to the APC model to adjust the pre-determined polish time of the buffing polish (step 48 in FIG. 2), so that for the subsequently polished wafers, the thickness measured in step 46 may match the final target thickness. It is noted that the deviation (thickness difference) of the thickness measured in step 46 from the final target thickness may be caused by one or more of the high-rate polish, the low-rate polish, the buffing polish, and the chemical cleaning. However, regardless of the source of the deviation, the thickness difference for the subsequent wafers may be fixed by adjusting the WiW APC and buffing APC model. Accordingly, the APC model is a dynamic model modified over time.

If the thickness measured in step 46 is substantially equal to or less than the final target thickness, the wafer is unloaded from polish platform 10 through loadlocks 12 (FIG. 1). Conversely, if the thickness measured in step 46 is greater than the final target thickness, the current wafer may be transferred back to buffing platen 22 to perform an additional buffing polish, followed by an additional cleaning. The additional buffing polish and the additional chemical cleaning are expected to reduce the ILD thickness to the final target thickness. The wafer is then unloaded. Optionally, the wafer may be further measured by the dry metrology 14, and the obtained thickness may be used to direct the further modification of the WiW APC model, and/or to direct a further round of buffing polish and chemical cleaning, if necessary.

The steps starting from the step of the buffing polish to the step of measuring the thickness of the ILD, and then using the ILD thickness to feed back to the step of the buffing polish, is referred to an integrated metrology close-loop control (IMCLC). The IMCLC in combination with the optional low-rate polish may achieve wafer-to-wafer (WiW) uniformity and lot-to-lot (LtL) uniformity. The WtW uniformity means from wafer to wafer the ILDs have substantially uniform thicknesses. The LtL uniformity means from lot to lot (with each lot including a plurality of wafers) the ILDs have substantially uniform thicknesses. Therefore, both the IMCLC and the low-rate polish have the function of improving WiW and LtL uniformity, which is indicated by block 50 in FIG. 2.

In the above-discussed embodiments, an ILD of a wafer is used as an example to explain the concept of the present invention. It is appreciated that the embodiments of the present invention may be used in the CMP of other features and materials, such as the CMP of copper to form copper lines. The process steps and concepts for polishing other features/materials are essentially the same as discussed in the preceding paragraphs. However, the equipment for measuring the thickness of the respective features may need to be changed.

The embodiments of the present invention have several advantageous features. First, by determining the thickness profile prior to the high-rate polish and adopting a customized polish recipe specially targeting the thickness profile, the high-rate polish may achieve WiW uniformity. On the other hand, the IMCLC and the low-rate polish may be used to achieve WtW uniformity and LtL uniformity. Further, with the metrology integrated into the polish platform and used before and after the polishes, the buffing APC model can be adjusted dynamically with the polish of each wafer, so that the WiW uniformity, WtW uniformity, and LtL uniformity may be continuously optimized. Experiment results have indicated that for 32 nm technology, the wafer may achieve nine points of WiW uniformity of less than about 100 Å, which is well within the desirable target range, while the WtW uniformity is improved from mean values of about 100 Å with the use of conventional APC models to about 50 Å with the use of the APC model of the present invention.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, and composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An apparatus for performing a Chemical Mechanical Polish (CMP), the apparatus comprising:

a wafer processing platform, comprising:

a thickness-measuring device configured to measure a thickness profile of a feature across a surface of a wafer, the thickness profile indicating the thickness of the feature at multiple points and in multiple dimensions across the surface of the wafer;

a controller coupled to the thickness-measuring device, wherein the controller is configured to determine a polish recipe from the thickness profile, and wherein the polish recipe is for substantially compensating for a non-uniformity in the thickness profile;

a zoned high-rate CMP platen configured to polish the feature using the polish recipe, with different zones of the high-rate CMP platen configured to apply different pressures on different zones of the wafer;

an un-zoned low-rate CMP platen configured to polish the feature at a rate lower than a rate of the high-rate CMP platen; and an unzoned buffing CMP platen;

wherein the thickness-measuring device measures the thickness profile prior to the wafer being placed into the high-rate CMP platen;

wherein the wafer processing platform is configured to transfer the wafer to the thickness measuring device prior to transferring the wafer to the high rate CMP platen and the low rate CMP platen; and wherein the polish recipe includes a first predetermined polishing time calculated to achieve a predetermined substantial within-wafer thickness uniformity stop for the high-rate CMP platen, a first predetermined wafer thickness stop for the low-rate CMP platen and a second predetermined polishing time to achieve a second predetermined wafer thickness stop for the buffing CMP platen.

2. The apparatus of claim 1, wherein the high-rate CMP platen comprises membranes configured to apply the different pressures on the different zones.

3. The apparatus of claim 1, wherein the low-rate CMP platen comprises an endpoint detecting device for monitoring thicknesses of the feature when the low-rate CMP platen polishes the feature, and wherein the low-rate CMP platen is configured to stop in response to a result of the endpoint detecting device.

4. The apparatus of claim 3, wherein the endpoint detecting device comprises a light source for projecting a light on the feature, and a sensing device for determining a thickness of the feature based on a reflected light from the feature.

5. The apparatus of claim 1, the wafer processing platform being further configured to:

after the buffing platen finishes buffing the wafer, transfer the wafer from the buffing platen and operate the thickness-measuring device to measure a thickness of the feature; and compare the thickness with a final target thickness of the feature to determine a thickness difference.

6. The apparatus of claim 5, wherein the controller is further configured to adjust the polish recipe based on the thickness difference.

7. The apparatus of claim 5 being further configured to, after the thickness difference is determined, send the wafer to a buffing platen to perform an additional polish for an additional polish time, wherein the additional polish time is determined based on the thickness difference.

8. The apparatus of claim 5 being further configured to, after the thickness difference is determined, send the wafer to an un-zoned one of the plurality of platens to perform an additional polish for an additional polish time, wherein the additional polish time is determined based on the thickness difference.

9. The apparatus of claim 1, wherein the thickness-measuring device comprises a dry metrology.

10. An apparatus for performing a Chemical Mechanical Polish (CMP), the apparatus comprising:

a dry metrology configured to measure a thickness profile of a feature at a surface of a wafer, the thickness profile indicating the thickness of the feature at multiple points and in multiple dimensions across the surface of the wafer;

a plurality of platens separate from the dry metrology and for polishing the feature with different polishing rates, wherein the plurality of platens is configured to perform a first CMP process on the feature using a polish recipe, the plurality of platens comprising:

a zoned high-rate CMP platen, with different zones of the high-rate CMP platen configured to apply different pressures on different zones of the wafer;

an un-zoned low-rate CMP platen configured to polish the feature at a rate lower than a rate of the high-rate CMP platen;

an un-zoned buffing CMP platen; and a controller for determining the polish recipe of the first CMP process for the wafer prior to polishing the wafer, the polish recipe based on the thickness profile of the wafer and a desired substantial within-wafer thickness uniformity of the feature of the wafer, wherein the polish recipe includes a predetermined polish time for the high-rate CMP platen and predetermined zone pressures for different zones of the high-rate CMP platen polish head, a first predetermined wafer thickness stop for the low-rate CMP platen and a second predetermined polish time calculated to achieve a second predetermined wafer thickness stop for the buffing CMP platen, wherein the first predetermined wafer thickness stop is greater than the second predetermined wafer thickness stop;

wherein the apparatus is further configured to, after the plurality of platens polishes the feature, send the wafer to one of the plurality of platens again to perform a second CMP process on the feature to adjust a thickness of the feature to a final target thickness.

11. The apparatus of claim 10 being configured to send the wafer to an un-zoned one of the plurality of platens to perform the second CMP process.

12. The apparatus of claim 11, wherein the un-zoned one of the plurality of platens comprises a soft polish pad.

13. The apparatus of claim 10 being further configured to:

after the step of performing the second CMP process, send the wafer to the dry metrology to measure a thickness of the feature;

compare the thickness with a final target thickness of the feature to determine a thickness difference; and feedback the thickness difference to adjust a pre-determined polish time for performing the second CMP process, wherein the adjusted pre-determined polish time is used by the apparatus in a CMP process of a subsequent wafer.

14. The apparatus of claim 10, wherein the thickness profile reflects a non-uniformity in a thicknesses of the feature throughout the wafer.

15. The apparatus of claim 1, wherein the buffing CMP platen comprises a soft polishing pad.

16. An apparatus for performing a Chemical Mechanical Polish (CMP), the apparatus comprising:

a dry metrology configured to measure a thickness profile of an inter-layer dielectric (ILD) of a wafer, the thickness profile indicating the thickness of the ILD at multiple points and in multiple dimensions across the surface of the wafer;

a controller for generating a polish recipe for the ILD prior to polishing the ILD and using the thickness profile of the ILD measured by the dry metrology, wherein the polish recipe is configured to substantially compensate for a non-uniformity of the thickness profile of the ILD, and wherein the polish recipes comprises a predetermined high rate polish time and a predetermined buffing polish time;

a zoned high-rate CMP platen configured to perform a high-rate CMP process on the ILD using the polish recipe according to the high rate polish time, the dry metrology measuring the thickness profile prior to the wafer being placed into the high-rate CMP platen;

an un-zoned low-rate CMP platen configured to perform a low-rate CMP process on the ILD, and configured to simultaneously monitor thicknesses of the ILD, wherein the low-rate CMP platen is further configured to stop the low-rate CMP process when the thicknesses of the ILD reach a target thickness; and an un-zoned buffing CMP platen configured to perform a buffing CMP process on the ILD according to the predetermined buffing polish time;

wherein the apparatus is further configured to, after receiving the wafer from the buffing CMP platen:

send the wafer to the dry metrology to perform an additional measurement to determine a thickness of the ILD;

comparing the thickness of the ILD obtained from the additional measurement with a final target ILD thickness to determine a thickness difference; and feedback the thickness difference to adjust the polish recipe.

17. The apparatus of claim 16, wherein the polish recipe comprises different pressures applied to different zones of the wafer.

18. The apparatus of claim 17, wherein the high-rate CMP platen comprises membranes configured to apply the different pressures on the different zones.

19. The apparatus of claim 16, wherein the low-rate CMP platen comprises a light source for projecting a light on the feature, and a sensing device for determining a thickness of the feature based on a reflected light from the feature.

20. The apparatus of claim 16, wherein the buffing CMP platen comprises a soft polishing pad.

* * * * *